United States Patent [19]

Merila

[11] 4,227,626

[45] Oct. 14, 1980

[54] SODA STRAW DISPENSER

[76] Inventor: John B. Merila, 6223 East 127th St., Grandview, Mo. 64030

[21] Appl. No.: 30,100

[22] Filed: Apr. 16, 1979

[51] Int. Cl.[3] ..... B65D 83/02

[52] U.S. Cl. ..... 221/188; 221/202; 221/266

[58] Field of Search ..... 221/186, 188, 202, 266, 221/177, 192, 196, 254

[56] References Cited

U.S. PATENT DOCUMENTS

| | | | |
|---|---|---|---|
| 929,823 | 8/1909 | Bouthinon | 221/188 X |
| 1,225,143 | 5/1917 | Kulick | 221/188 |
| 1,226,498 | 5/1917 | Frederick | 221/188 |
| 1,505,503 | 8/1974 | Stewart | 221/188 |
| 1,508,952 | 9/1924 | Bennett | 221/188 |
| 2,382,350 | 8/1945 | Testi | 221/188 |

FOREIGN PATENT DOCUMENTS

| | | | |
|---|---|---|---|
| 270802 | 1/1930 | Italy | 221/188 |

*Primary Examiner*—David A. Scherbel
*Attorney, Agent, or Firm*—John A. Hamilton

[57] ABSTRACT

A soda straw dispenser consisting of a fixed body having an outlet for a single straw, a container movable within said body member and also having an outlet for a single straw, an ejector member carried by the container, the ejector member normally being open to the container for receiving a single straw therein, and mechanism carried by the container and operable to close the ejector member to the container and open it to the container outlet, when the body and container outlets are in registering relation.

10 Claims, 5 Drawing Figures

SODA STRAW DISPENSER

This invention relates to new and useful improvements in soda straw dispensers, especially of the type commonly used at soda fountains, fast-food restaurants, lunch counters and the like for dispensing straws directly to the individual customers.

The overall object of the present invention is the provision of a soda straw dispenser which will, upon actuation of a manual control, reliably dispense one straw at a time from a large supply to an external station where it may be grasped and removed by the operator, with a virtually failure-proof and jamb-proof operation.

More specifically, an object of this invention is the provision of a straw dispenser consisting of a body member adapted to rest on a counter or the like and having an outlet opening for a single straw, a straw container for a large member of straws disposed within the body member and also having an outlet opening for a single straw, said container being normally biased to a first position relative to the body member in which said outlet openings are out of registry, and a second position, to which to which it may be moved manually, in which the outlet openings are disposed in registered relation, an ejector member carried by said container and disposed in the outlet opening thereof, said ejector member being normally biased to a first position in which it obstructs said outlet opening but opens into the container for receiving a single straw therein, and a second position in which it obstructs the entry of any other straw thereinto, but opens to said outlet opening to discharge the single straw disposed therein through said outlet, and automatic operating means functioning to move said ejector member from its first to its second position as said container is moved manually from its first to its second position. The ejected straw then passes through both outlet openings to a position external to the body member, where it may conveniently be grasped and removed.

Another object is the provision of a dispenser of the character described including means operable automatically by the movement of the container to its second position, and by its return to its first position, to agitate or jostle the straws in the container, thus tending to realign and rearrange any straws which may have became disarranged or out of line, in order that they may be caused to enter the ejector more reliably.

A further object is the provision of a dispenser of the character described including means operable virtually to force a single straw into the ejector on every operation of the dispenser, to further increase its reliability of operation.

Other objects are simplicity and economy of construction, efficiency and reliability of operation, and ease and convenience of use.

Figure 1:
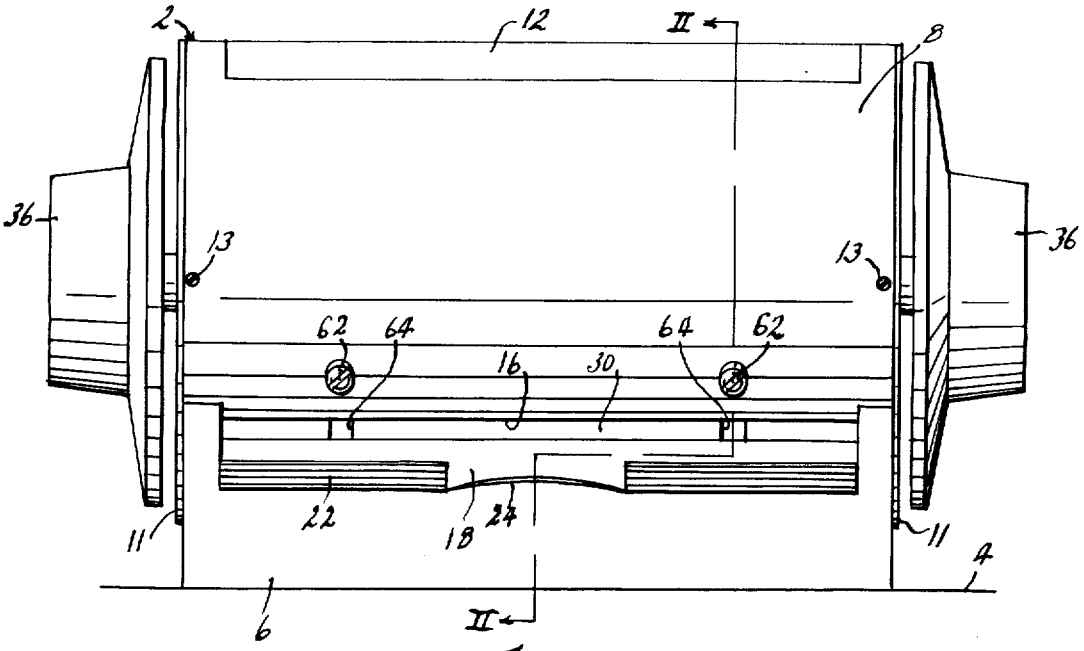
Figure 2:
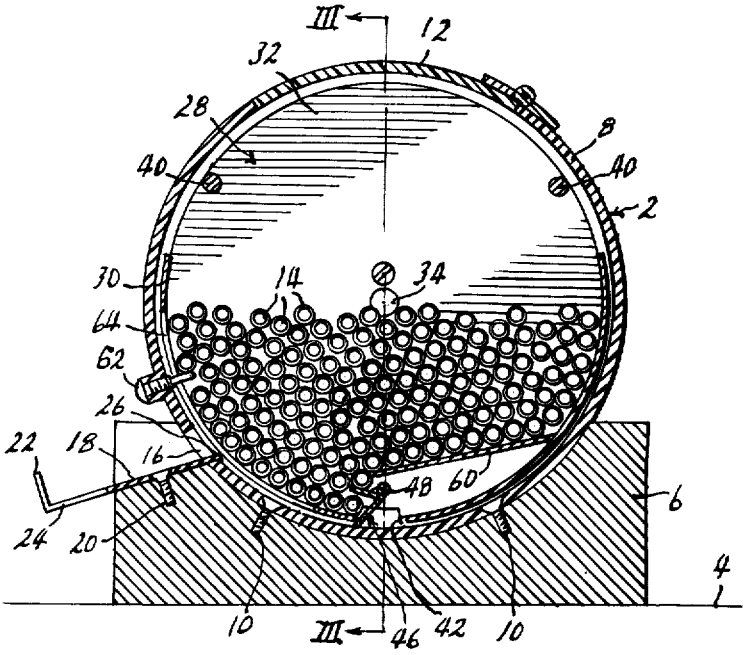
Figure 3:
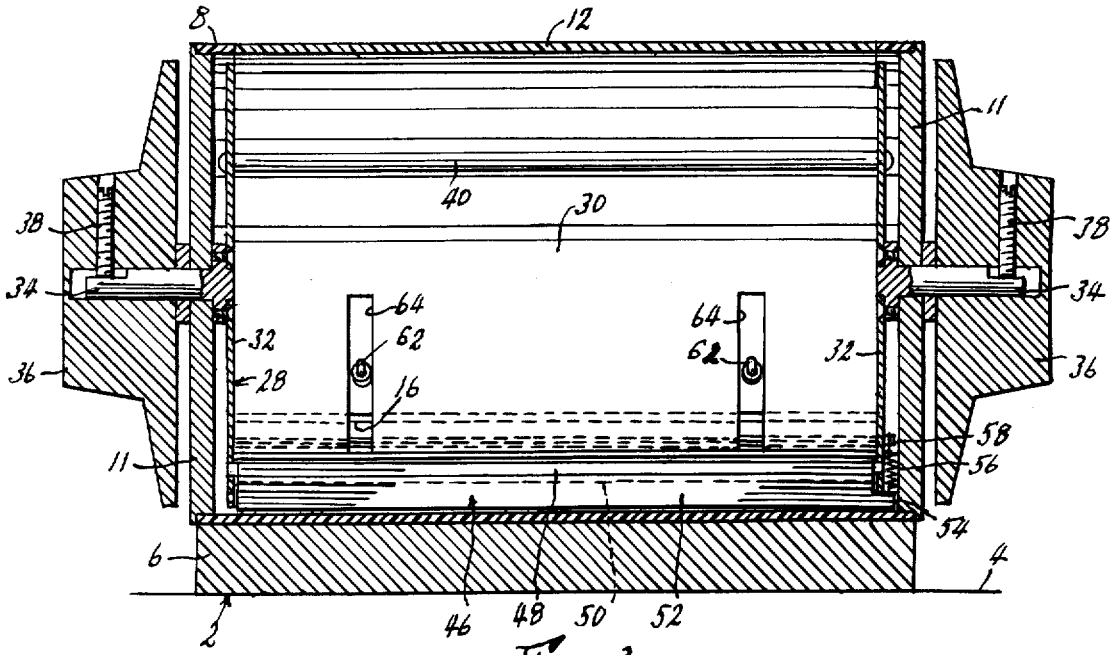
Figure 4:
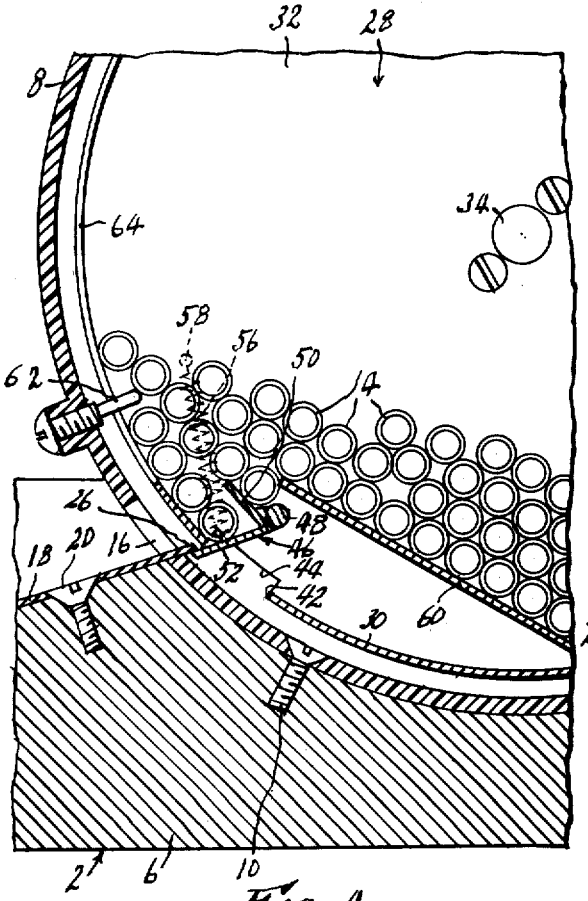
Figure 5:
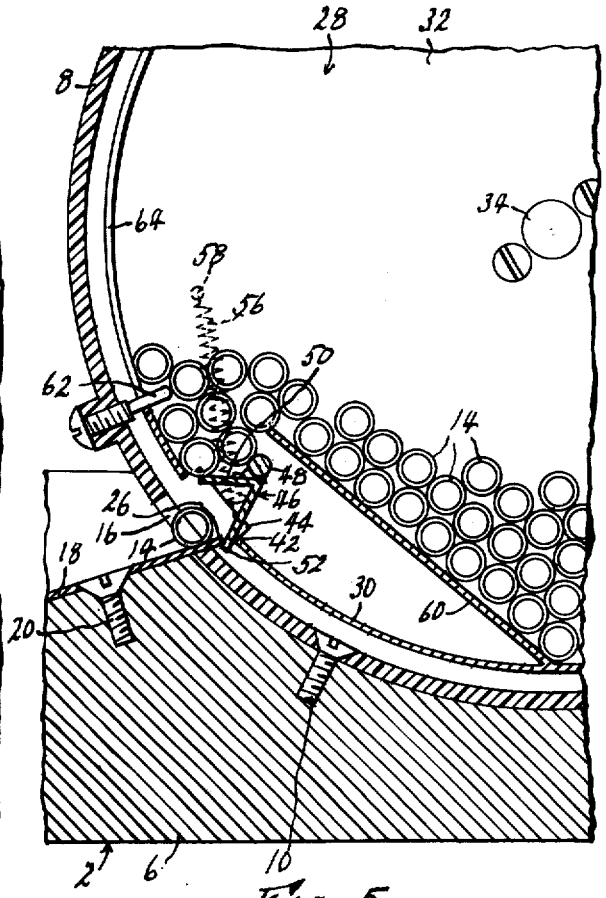

With these objects in view, as well as other objects which will appear in the course of the specification, reference will be had to the accompanying drawing wherein:

FIG. 1 is a front elevational view of a soda straw dispenser embodying the present invention, FIG. 2 is a sectional view taken on line II—II of FIG. 1, with the straws left in elevation, FIG. 3 is a sectional view taken on line III—III of FIG. 2, with the straws omitted, FIG. 4 is an enlarged fragmentary view similar to FIG. 2, with the parts shown in their relative positions just prior to the ejection of a straw, and FIG. 5 is a view similar to FIG. 4, showing the parts in their relative positions at the moment of ejection of a straw.

Like reference numerals apply to similar parts throughout the several views, and the numeral 2 applies to a body member adapted to rest on a counter 4 or the like, and including a base 6 adapted to rest directly on said counter, and a hollow cylindrical drum 8 with its axis disposed horizontally fixed in a shallow cylindrically curved recess formed in the top of base 6, as by screws 10. The base may be formed of any suitable material, while drum 8 is preferably, though not necessarily, formed of a transparent material in order that straws carried therein may be visible. The drum is provided at each end with an end wall 11 secured therein by screws 13 (see FIG. 1). A top portion of the drum is closed by a hinged door 12, in order that straws 14 may be inserted in a position parallel to the axis of the drum. The drum is provided at its lower forward portion with a longitudinal slot 16, somewhat longer than each of the straws, through which, as will appear, the straws 14 are ejected one at a time. A discharge plate 18 extends the full width of slot 16, and is inclined downwardly and outwardly from the lower edge of said slot, being affixed as by screws 20 to an inclined upper surface of base 6, so that a straw ejected through slot 16 rolls downwardly and forwardly along said plate. Said plate extends forwardly of base 6, and is turned upwardly at its forward edge to form a lip 22 for arresting movement of the straw. Said lip, and the forward portion of the plate, is notched out as indicated at 24, so that the straw may be grasped for easy removal. The rearward edge of plate 18 projects slightly into the interior of drum 8 to form a lip 26, the function of which will be described hereinbelow.

Carried within drum 8, coaxially therewith, is a rotor designated generally by the numeral 28, and including a cylindrically curved bin 30, said bin being of slightly smaller diameter than the drum and of less than full circular extent, a pair of circular end walls 32 affixed to the bin and disposed respectively inwardly from drum end walls 11, a stub axle 34 affixed axially in each of said rotor end walls and projecting outwardly therefrom, said axles being journalled in the drum end walls, and a knob 36 affixed to the extended end of each axle, exteriorly of the drum, as by set screw 38, whereby the rotor may be turned manually. End walls 32 of the rotor may also be connected by rods 40 extending therebetween parallel to the rotor axis (see FIG. 2). Bin 30 normally contains straws 14, as shown and due to the eccentric position of the weight of bin 30, relative to axles 34, the rotor will normally come to rest with said bin in a lowermost position of the rotor, whenever knobs 36 are released. Along the line of the bin which is then lowermost, said bin has a slot 42 formed therethrough parallel to the rotor axis. Said slot extends the full width of the bin between its end walls 32, and said end walls are notched as indicated at 44, in registration with slot 42.

Disposed in controlling relation to bin slot 42 is a straw ejector member designated generally by the numeral 46, and best shown in FIGS. 3-5. Said ejector member comprises an elongated angle-iron member extending between rotor end walls 32, parallel to the rotor axis, and affixed to a pivot rod 48 disposed closely adjacent slot 42, and journalled pivotally at its ends in said end walls. The ejector includes a leading leg 50 and a trailing leg 52, both extending approximately radially from rod 48. Trailing leg 52 projects slightly outwardly from the bin through slot 42 thereof, so that engagement thereof with the bin at the forward and rearward edges of said slot limits the pivotal movement of the ejector. At at least one end of the ejector, trailing leg 52 is provided with an ear 54 which projects outwardly, parallel to rod 48, through the notch 44 of the associated rotor end wall 32, and said ear is connected by a tension spring 56 disposed between the associated end walls 32 and 11 to a pin 58 fixed in end wall 32. Thus the ejector member is biased continually toward what may be termed its normal or forward position relative to the bin, shown in FIGS. 2 and 4, in which leading leg 50 projects forwardly in generally parallel but inwardly offset relation from the adjacent portion of the bin wall, while trailing leg 52 engages the forward edge of bin slot 42, being held in engagement therewith by spring 56, and projects slightly outwardly from the bin, as shown. The bin is provided with an internal deflector plate 60 which, when the rotor is positioned normally as in FIG. 2, slopes downwardly and forwardly from a line of the interior wall of the bin behind ejector 46 to a point just above pivot rod 48 of the ejector.

Finally, drum 8 is provided with a pair of pins 62 threaded or otherwise affixed in the forward wall thereof, in spaced relation above straw discharge slot 16 thereof, and spaced so as to be disposed, for example, at the quarter points of the length of the straws carried in the bin. Said pins extend radially inwardly of the drum, and project through peripherally elongated slots 64 of bin 30 into the interior of said bin. Said pins and slots permit limited rotational movement of the rotor.

In operation top door 12 of drum 8 is opened and the interior of the drum and bin 30 may be filled with straws 14. Even if the drum is filled to a level above the top of the bin, the straws will be supported primarily by the bin, since the annular space between the bin and the drum is too narrow to admit straws thereinto. So long as rotor 28 is left free to turn on its axles 34, it will remain by gravity in the position thereof shown in FIG. 2, with discharge slot 42 of the bin at the lowermost point, and with ejector member 46 biased to its normal forward position by spring 56. With the rotor in this position, straws fall by gravity, and one straw only will be positioned between the leading and trailing legs 50 and 52 of ejector 46, being supported primarily on the inner surface of the bin. Even if only a single straw is present in the bin, deflector plate 60 functions to deposit it in front of the ejector, so that it will roll rearwardly beneath leading leg 50 of the ejector. The ejector may be viewed as a container of a size sufficiently small to receive only a single straw therein, and which at this time is open to the interior of the bin to receive said single straw, but in which it also, in conjunction with deflector plate 60, blocks bin discharge slot 42 against the passage of any straw therethrough.

To dispense a straw, the user grasps either of knobs 36 manually and turns it to pivot rotor 30, in a clockwise direction as viewed in FIGS. 2, 4 and 5, from the FIG. 2 position, through the FIG. 4 position to the FIG. 5 position. As the rotor reaches the FIG. 4 position the edge portion of trailing leg 52 projecting outwardly through bin slot 42 engages the lip 26 of discharge plate 18. Since said lip is of course stationary, the final portion of the movement of the rotor causes said lip to pivot the ejector rearwardly to a position, relative to the bin, as shown in FIG. 5, until said trailing leg is trapped between lip 26, and the rearward edge of bin slot 42, also as shown in FIG. 5, whereupon rotation of the rotor is arrested. During the pivoting of the ejector to this position, which may be termed its rearward or ejection position, trailing leg 52 thereof moves to open slot 42, and leading leg 50 thereof moves to discharge the single straw disposed within the ejector through said slot. Also as shown in FIG. 5, slot 42 is disposed in registry with discharge slot 16 of drum 8, so that the discharged straw moves through the latter slot, rolling downwardly and forwardly on discharge plate 18 to come to rest against lip 22 thereof, where it may be grasped within notch 24 for easy removal. Thus it will be apparent that ejector member 46 constitutes an open-sided container of a size for containing a single straw, and while always so placed as to obstruct discharge slot 42 against uncontrolled movement of straws through said slot, being movable from a first position in which it opens into the bin for receiving a straw therein, to a second position in which it opens outwardly through said slot to discharge said straw. Since the ejector is normally disposed at the lowermost point of the bin, straws are delivered thereto by gravity, and since it discharges the straw carried therein downwardly, the discharge is also by gravity. When knobs 36 are released, rotor 28 returns to its normal FIG. 2 position by gravity, another straw enters the ejector by gravity, and the device is ready to dispense said straw on the next operation thereof.

It will be seen that the pivoting of the ejector member from its loading position (FIGS. 2 and 4) to its discharge position (FIG. 5) occurs as the rotor moves through a small angle of rotation. Hence, for any normal rate at which the rotor may be turned manually, the ejector is pivoted very rapidly indeed, its motion, compared to the turning rate of the rotor, being multiplied by the ratio between the turning radius of ejector pivot 48 about rotor axles 34, to the turning radius of the outer edge of ejector leg 52 about pivot 48. Thus the motion of the ejector tends to be accomplished with a rapid "snap" action, which literally "throws" the straw through slots 42 and 16. This action virtually eliminates any possibilty that the rotor could "rebound" away from its FIG. 5 position before the straw is fully free of the ejector and clear of the orbit of the bin, and hence eliminates a possible cause of malfunciton.

Pins 62 have at least two valuable functions. First being stationary, they serve to agitate the mass of straws carried in the bin each time a straw is dispensed. This agitation tends to jostle the straws to align them parallel to the rotor axis, and hence in a proper position to enter the ejector, in the event they have became misaligned, or "jumbled", at various angles to the rotor axis, as could occur if they are inserted into the bin carelessly. This tends to eliminate another possible cause of malfunctions. Moreover, pins 62 are so positioned that they agitate the straws forwardly of the ejector, so that they realign those straws which will be next to enter the ejector. Secondly, pins 62 form fixed obstructions to forward movement of straws with the bin as the ejector moves toward its discharge position, this obstruction being disposed just forwardly of the ejector. Thus, if a straw has failed to enter the ejector, the pins act a "pushers" tending literally to force a straw into the ejector, thereby tending to eliminate another possible cause of malfunction. Failure of a straw to enter the ejector can occur when the entry of one straw is blocked by another straw also not disposed within the ejector, particularly when the bin is fully loaded with straws so that the straws directly at the entry to the ejector carry a relatively heavy top load. Additionally, pins 62, by engaging the bin at the top ends of slots 64 thereof, limit backward turning of rotor 28 from its normal FIG. 2 position.

While I have shown and described a specific embodiment of my invention, it will be readily apparent that many minor changes of structure and operation could be made without departing from the spirit of the invention.

What I claim as new and desire to protect by Letters Patent is:

1. A soda straw dispenser comprising:

a. a body member, b. a bin carried by said body member for movement between first and second positions relative thereto and adapted to contain soda straws resting horizontally therein, said bin having a discharge slot through which straws may be discharged, an ejector member carried movably by said bin and obstructing said discharge slot against uncontrolled movement of straws therethrough at all positions thereof relative to said bin, said ejector comprising an open-sided container of a size to receive and contain a single straw therein, and being movably carried by said bin between a first position in which it opens inwardly into said bin to receive a straw therein, and a second position in which it opens outwardly through said slot to discharge said single straw, d. means biasing said bin and said ejector member yieldably to said first positions, and e. manually operable means for concurrently moving said bin and said ejector member from said first positions to said second positions.

2. A dispenser as recited in claim 1 wherein said discharge slot and ejector member of said bin are disposed in a lower portion of said bin, whereby the movement of each straw into said ejector, and its discharge from said ejector, are accomplished by gravity.

3. A dispenser as recited in claim 1 wherein said bin is movably mounted on said body member for movement between said first position, to which it returns by gravity whenever released, and said second position, and wherein said manually operable means comprises:

a. manually operable means for moving said bin from its first to its second position, and b. cooperating actuator members carried respectively by said ejector member and said body member and operable, as said bin approaches its second position, to move said ejector member from its first position to its second position.

4. A dispenser as recited in claim 3 wherein said cooperating actuator members function to move said ejector member from its first position to its second position at a rate substantially multiplied as compared to the rate of movement of said bin, whereby motion of said ejector member is accomplished with a relatively rapid snap action.

5. A dispenser as recited in claim 3 with the addition of agitator members mounted on said body member and projecting into said bin, whereby straws carried in said bin are agitated by said agitator members as said bin moves between its first and second positions.

6. A dispenser as recited in claim 3 wherein said ejector member, in its first position, opens into said bin in the direction of movement of said bin from its first position to its second position, and with the addition of pins mounted on said body member and projecting into said bin at positions spaced apart from the open side of said ejector member when said bin is in its second position, whereby said pins tend to force straws into said ejector member as the bin moves from its first position to its second position.

7. A dispenser as recited in claim 3 wherein said body member includes a housing completely enclosing said bin, and having a straw discharge slot positioned to register with said discharge slot of said bin when said bin is in its second position, whereby a straw discharged by said ejector member through said bin discharge slot passes outwardly through said housing discharge slot.

8. A dispenser as recited in claim 3 wherein said body member comprises a base and a hollow drum housing mounted on said base with its axis disposed horizontally, said housing having a top opening for the insertion of straws and a longitudinal straw discharge slot formed longitudinally therein in angularly offset relation from its lowermost point; and wherein said bin comprises a hollow, normally upwardly-opening partial cylinder mounted coaxially and rotatably in said housing said bin being eccentrically weighted to return to a given position by gravity whenever released, this being said first position of said bin, at which position said straw discharge slot of the bin, and said ejector member, are disposed at the lowermost point of said bin, said second position of said bin occuring when it has been rotated by said manual means sufficiently to register the discharge slot thereof with the discharge slot of said housing.

9. A dispenser as recited in claim 8 with the addition of a plurality of pins mounted in said housing in longitudinally spaced relation therealong, in angularly spaced relation from the straw discharge slot thereof at the side of said slot opposite to the side thereof approached by the discharge slot of said bin as said bin moves toward its second position, said pins projecting radially into said bin through peripherally elongated slots of said bin, whereby to agitate straws within the bin during movement of the latter, and to urge straws to enter said ejector member, said ejector member, when in its first position, opening into the bin in the direction of movement of the bin from its first position to its second position.

10. A dispenser as recited in claim 8 wherein the base portion of said body member includes a planar surface inclined downwardly and outwardly from the lower edge of the straw discharge slot of the drum portion of said body member, whereby a straw dispensed through said slot will roll downwardly along said surface, and an upturned lip at the lower edge of said inclined surface for arresting the movement of said straw.

* * * * *